US005711181A

United States Patent [19]

Mitsuyoshi

[11] Patent Number: 5,711,181

[45] Date of Patent: Jan. 27, 1998

[54] DIE AND DIE ASSEMBLY FOR PRESS BRAKE

[75] Inventor: Nobuya Mitsuyoshi, Onomichi, Japan

[73] Assignee: Amada Metrecs Company, Limited, Kanagawa, Japan

[21] Appl. No.: 311,255

[22] Filed: Sep. 23, 1994

[30] Foreign Application Priority Data

Sep. 27, 1993 [JP] Japan ..... 5-059162

[51] Int. Cl.[6] ..... B21D 5/02

[52] U.S. Cl. ..... 72/389.4; 72/477; 72/481.1; 72/482.92; 425/183; 425/195

[58] Field of Search ..... 425/195, 183, 425/193, 394, 396; 72/477, 389.4, 482.92, 481.1

[56] References Cited

U.S. PATENT DOCUMENTS

| | | | |
|---|---|---|---|
| 3,109,476 | 11/1963 | Giordano | 72/415 |
| 4,510,789 | 4/1985 | Tomioka et al. | 72/442 |
| 4,866,975 | 9/1989 | Hopkins | 72/448 |

FOREIGN PATENT DOCUMENTS

| | | |
|---|---|---|
| 1931714 | 1/1971 | Germany . |
| 1452821 | 4/1971 | Germany . |
| 54-2739 | 1/1979 | Japan . |

OTHER PUBLICATIONS

European Search Report dated 21 Dec. 1994.

*Primary Examiner*—Thomas R. Weber

*Attorney, Agent, or Firm*—Wigman, Cohen, Leitner & Myers, P.C.

[57] ABSTRACT

A die for a press brake is formed with: a first V-shaped groove (43A) extending in a longitudinal direction and on an upper surface thereof; a second V-shaped groove (43B) extending in the same way in parallel to the first V-shaped groove; a plurality of first engage slots (45A) arranged on a lower surface thereof in parallel to the first V-shaped groove by a predetermined distance (A) from a central bottom line of the first V-shaped groove; and a plurality of second engage slots (45B) arranged in the same way in parallel to the second V-shaped groove by the same predetermined distance from a central bottom line of the second V-shaped groove. The first and second engage slots (45A, 45B) are used in common for alignment of the first and second V-shaped grooves (43A, 43B) with a punch (7) mated to the die. Accordingly, after one of the V-shaped grooves has been aligned with the punch, even if the two V-shaped grooves are replaced with each other, the die can be used immediately without any additional alignment with the punch.

7 Claims, 4 Drawing Sheets

DIE AND DIE ASSEMBLY FOR PRESS BRAKE

BACKGROUND OF THE INVENTION

1. Field of the Invention

The present invention relates to a die and a die assembly for a press brake, and more specifically to a die formed with a plurality of V-shaped grooves and a die assembly having a die base for supporting the die in such a way that the V-shaped grooves can be replaced without any alignment with respect to a punch, whenever the die is removed from the die base for die replacement, insofar as the die has been once aligned with the punch.

2. Description of the Related Art

FIG. 1A shows a first example of a conventional bending tool (a pair of die and punch) for a press brake, in which an upper table 1 and a lower table 3 are arranged so as to be opposed to each other in the vertical direction. Further, any one of the upper and lower tables 1 and 3 is moved vertically relative to the other. A punch (the upper bending tool) 7 is removably and replaceably attached to the upper table 1 by a fixing member 5. A die (the lower bending tool) 11 is also removably and exchangeably attached to the lower table 3 by a die holder 9.

Further, in FIG. 1A, when a plate material (work) W is set onto the die 11 and then the lower end of the punch 7 is lowered so as to be engaged with a first V-shaped groove 13A formed in the upper surface of the die 11, it is possible to bend the work W into a V-shape.

In the above-mentioned bending tool, a second V-shaped groove 13B of the die 11 is often used when the plate thickness and/or material of the work W change, without changing the punch 7. In this case, the necessary procedure is as follows: the die 11 is first removed from the die holder 9 by unfastening a plurality of fixing bolts 15 screwed into the bolt holes arranged in a lower surface of and in the longitudinal direction of the die 11; secondly, the front and rear direction (the right and left direction in FIG. 1A) of the removed die 11 is reversed; thirdly the second V-shaped groove 13B is aligned with respect to the punch 7; and lastly the fixing bolts 15 are all fastened again.

Therefore, whenever the die 11 is removed and then reversed, since a number of fixing bolts 15 must be unfastened and then fastened, there exists a problem in that the die replacement work is troublesome.

To overcome the above-mentioned problem, another die assembly as shown in FIG. 1B has been proposed, as disclosed in Japanese Published Unexamined Utility Model Application No. 54-2739. In this second example of the conventional die assembly, a die base 17 is interposed between a die 11 and a die holder 9. In more detail, a plurality of fixing bolts 15 are arranged in the lower surface of the die base 17. Further, the die base 17 is formed with a guide projection portion 19 in the upper surface thereof so as to extend in a longitudinal direction (a direction perpendicular to paper in FIG. 1B) at the middle of the width direction (the right and left direction in FIG. 1B) thereof. Further, the die 11 is formed with an engage groove 21 in the lower surface thereof so as to be engaged with the guide projection portion 19 along the overall length of the die 11.

In this second conventional die assembly, a dimension A between the central bottom line of the first V-shaped groove 13A and one end (the left side) of the engage groove 21 is determined to be equal to a dimension B between the central bottom line of the second V-shaped groove 13B and the other end (the right side) of the engage groove 21. Therefore, the first V-shaped groove 13A can be aligned with respect to the punch 7 by designating one side surface of the guide projection portion 19 as the tool reference plane. After the alignment, the die base 17 is fixed to the die holder 9 by fastening the fixing bolts 15.

In summary, in this second example, the die reversing procedure after the die base 17 has been once fixed to the die holder 9 (after alignment) is as follows: the engagement between the guide projection portion 19 of the die base 17 and the engage groove 21 of the die 11 is released to remove the die 11 from the die base 17; the front and rear direction of the die 11 is reversed; and the engage groove 21 is engaged again with the guide projection portion 19 to locate the die 11 so that the second V-shaped groove 13B can be aligned with the lower end of the punch 7.

In this second conventional die assembly, after the die base 17 has been once located and fixed to the die holder 9 after alignment, even if the V-shaped groove is replaced relative to the die base 17, since any one of the first and second V-shaped grooves 13A and 13B has been already aligned with respect to the punch 7, it is possible to solve the problem involved in the first conventional die assembly.

In the above-mentioned second conventional die assembly, however, since the engage groove 21 must be formed in the lower surface of the die 11, a vertical distance between the bottom of the V-shaped groove 13A or 13B and the bottom of the engage groove 21 decreases, so that the strength of the die 11 is inevitably lowered. Therefore, in order to ensure the strength of the die 11, it is necessary to increase a vertical height of the die 11 in comparison with that of the ordinary die.

As a result, since the thicknesses of the die base 17 and the die 11 increase, the open height of the bending tool (the space between the lower end of the punch 7 and the upper surface of the die 11) is inevitably reduced, as compared with the ordinary die assembly, thus causing a problem in that the work processing space is reduced.

In addition, in the second conventional die assembly, one long side surface of the guide projection portion 19 extending in the longitudinal direction is determined as a tool reference plane, and further both of the side surfaces of the engage groove 21 of the die 11 are also determined as the tool reference planes. Therefore, once the die 11 is slightly distorted in width (front and rear direction) due to heat treatment, for instance, a problem arises in that the guide projection portion 19 cannot be engaged with the engage groove 21 along the overall length of the die 11.

Further, one side surface of the guide projection portion 19 of the die base 17 (the tool reference plane) must be formed and finished at right angles with high precision relative to the upper surface of the die base 17. Further, both side surfaces of the engage groove 21 of the die 11 (the tool reference planes) must also be formed and finished at right angles with high precision relative to the lower surface of the die 11. As a result, there exists another problem in that high precision machining is required for the respective tool reference planes and thereby the manufacturing cost increases.

Further, when the width of the V-shaped groove 13A is increased by keeping the wall thickness T (see FIG. 1B) of the shoulder portion of the V-shaped groove 13A at a constant dimension, since the dimension A is inevitably reduced, it is impossible to obtain an appropriate dimension A between the central bottom line of the V-shaped groove 13A and the side surface (the tool reference plane) of the guide groove 21 (because the engage groove 21 is formed at the middle of the die 11), so that there arises another problem in that the total width of the die 11 inevitably increases.

SUMMARY OF THE INVENTION

With these problems in mind, therefore, it is the primary object of the present invention to provide a die and die assembly for a press brake, which can eliminate the task of alignment of the V-shaped groove with the punch, whenever the V-shaped grooves are replaced with each other, insofar as the die has been once aligned with the punch.

To achieve the above-mentioned object, the present invention provides a die for a press brake, formed with: a first V-shaped groove (43A) extending in a longitudinal direction and on an upper surface thereof; a second V-shaped groove (43B) extending in the longitudinal direction and on the upper surface thereof in parallel to the first V-shaped groove; a plurality of first engage slots (45A) arranged on a lower surface thereof in parallel to the first V-shaped groove by a predetermined distance away (A) from a central bottom line of the first V-shaped groove in a lateral direction thereof; and a plurality of second engage slots (45B) arranged on the lower surface thereof in parallel to the second V-shaped groove by the same predetermined distance away (B=A) from a central bottom line of the second V-shaped groove in the lateral direction thereof.

Further, the first and second engage slots (45A, 45B) are used in common for alignment of the first and second V-shaped grooves (43A, 43B) with a punch (7) mated to the die. Further, the first and second engage slots (45A, 45B) are arranged so as to be offset from each other in the longitudinal direction of the die. Further, the first engage slots (45A) and the second engage slots (45B) are replaced with common engage slots (45) arranged in a straight line and equidistant from the central bottom lines of the first and second V-shaped grooves.

Further, the present invention provides a die assembly for a press brake, comprising: a die (35) formed with: a first V-shaped groove (43A) extending in a longitudinal direction and on an upper surface thereof; a second V-shaped groove (43B) extending in the longitudinal direction and on the upper surface thereof in parallel to the first V-shaped groove; a plurality of first engage slots (45A) arranged on a lower surface thereof in parallel to the first V-shaped groove and displaced by a predetermined distance away (A) from a central bottom line of the first V-shaped groove in a lateral direction thereof; and a plurality of second engage slots (45B) arranged on the lower surface thereof in parallel to the second V-shaped groove and displaced by the same predetermined distance away (B=A) from a central bottom line of the second V-shaped groove in the lateral direction of said die; a die base (33) having a plurality of engage members (41) arranged on an upper surface thereof so as to be engageable with any of the first and second engage slots (45A, 45B) respectively; when said die is reversed in the lateral direction thereof and mounted on said die base to replace the first V-shaped groove with the second V-shaped groove or vice versa; a die holder (9) fixed to a lower table (3) of the press brake; and fixing members (31) for fixing said die base to said die holder.

Further, it is preferable that the engage members (41) are engage pins. Further, the engage pins (41) are arranged so as to be offset from a central longitudinal line of said die base in a lateral direction of the die base. Further, the engage pins (41) are arranged so as to be offset rearward from the central longitudinal line of said die base in the lateral direction of the die base. Further, each of said engage pins (41) further comprises a roller (41C) or a radial bearing (41D) at the outer circumference thereof. Further, each of said engage pins (41) is composed of a large-diameter portion (41A) and a small-diameter portion (41B) implanted in said die base (33), the large-diameter portion being formed eccentric from the small-diameter portion for easy and fine positional adjustment of said pin.

In the die and the die assembly for a press brake according to the present invention, firstly the engage slots formed in the lower surface of the die are engaged with the engage members attached on the upper surface of the die base; secondly, the die base is mounted onto the die holder; thirdly the V-shaped groove formed in the upper surface of the die is aligned with the punch fixed to the upper table; and lastly, the die base is fixed to the die holder.

Under these conditions, even if the V-shaped grooves of the die are replaced with each other relative to the die base, since the engage slots are formed at positions equidistant away from each of the two V-shaped grooves, when the engage slots formed in the lower surface of the die are engaged with the engage members attached on the upper surface of the die base, it is possible to obtain an alignment condition of any of the V-shaped grooves with respect to the punch. In other words, after the die base has been fixed to the die holder after alignment, even if the V-shaped grooves are replaced with each other relative to the die base, it is not necessary to align the V-shaped groove again, with the result that the die replacement work can be simplified.

DETAILED DESCRIPTION OF THE EMBODIMENTS

Figure 1A:
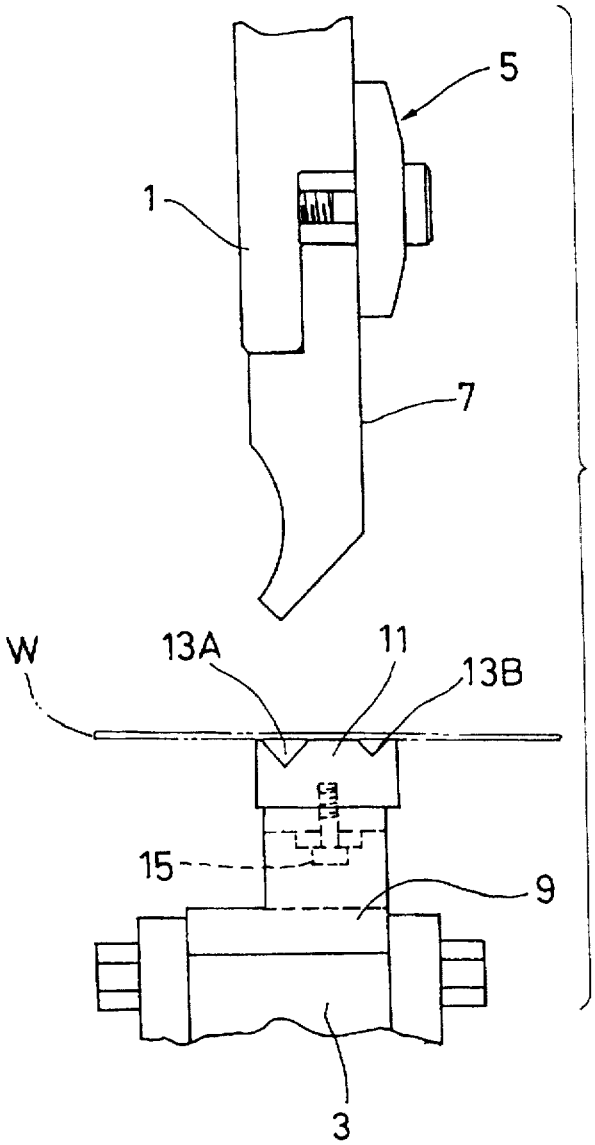
FIG. 1A PRIOR ART
FIG. 1A is a side view showing a first conventional die and die assembly for a press brake.
Figure 1B:
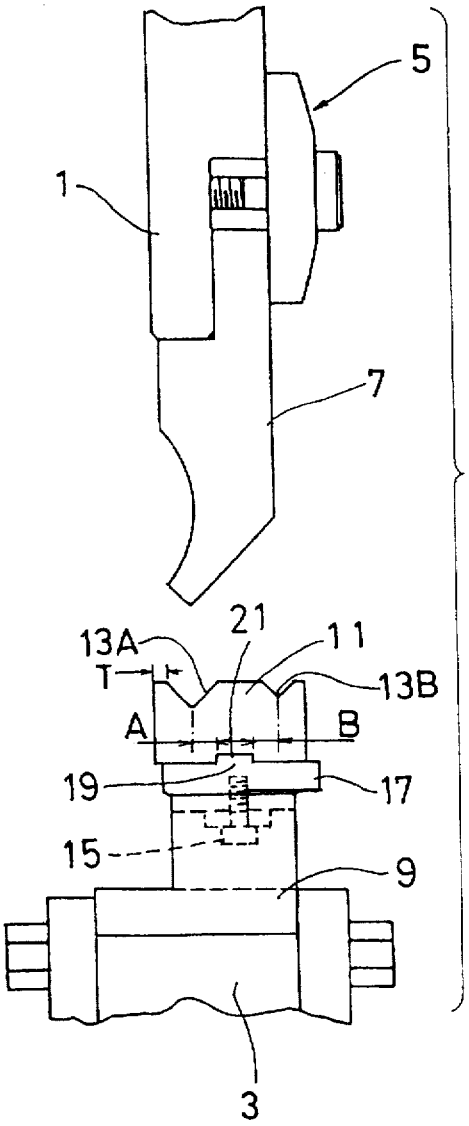
FIG. 1B PRIOR ART
FIG. 1B is a side view showing a second conventional die and die assembly for a press brake.

An embodiment of the die and the die assembly according to the present invention will be described hereinbelow with reference to the attached drawings, in which the same reference numerals have been retained for the similar parts or elements which have the same functions as with the case of the conventional die assemblies shown in FIGS. 1A and 1B without repeating the similar description thereof.

Figure 2:
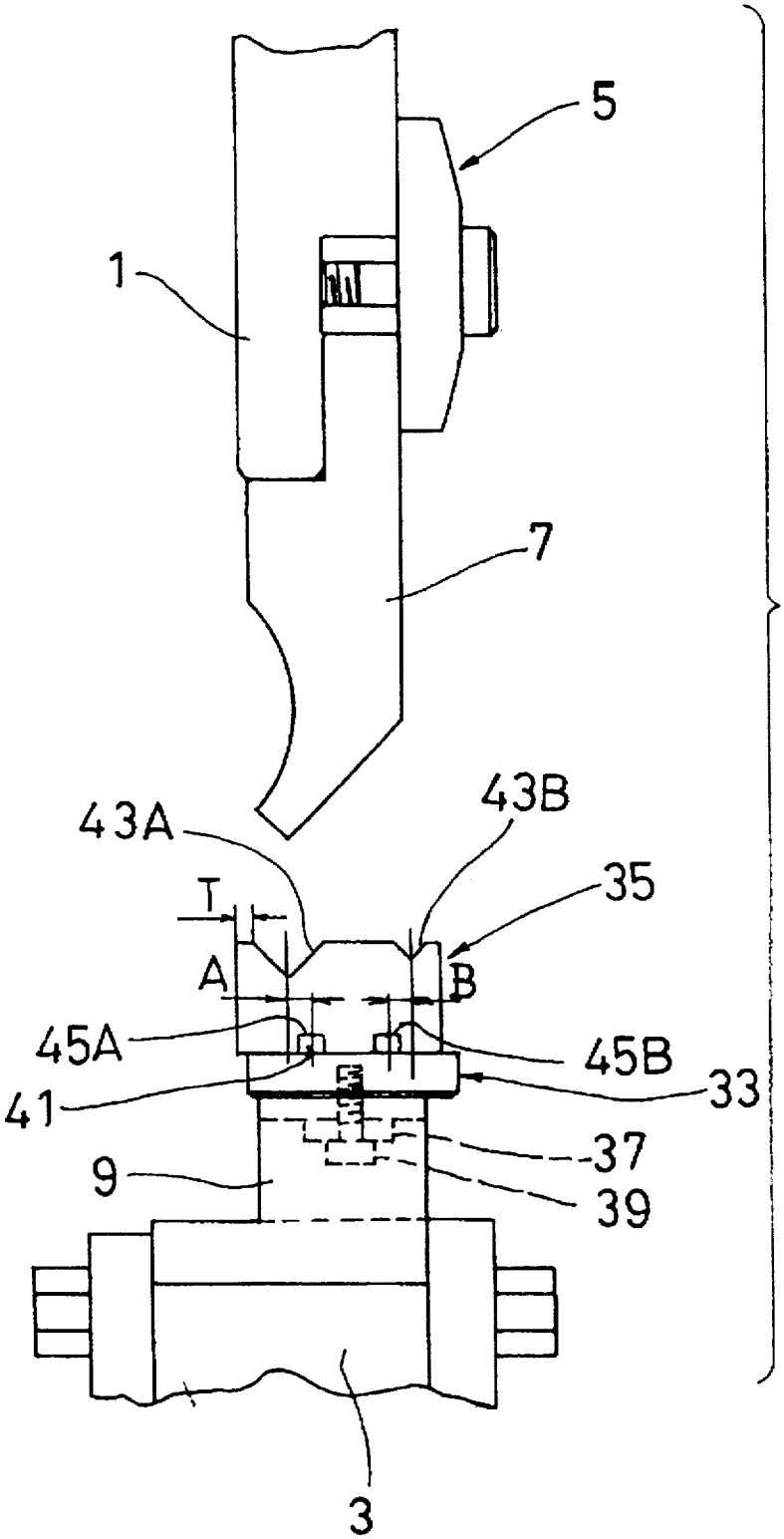
FIG. 2 is a side view showing an embodiment of the die and the die assembly mounted on a press brake according to the present invention.
Figure 3:
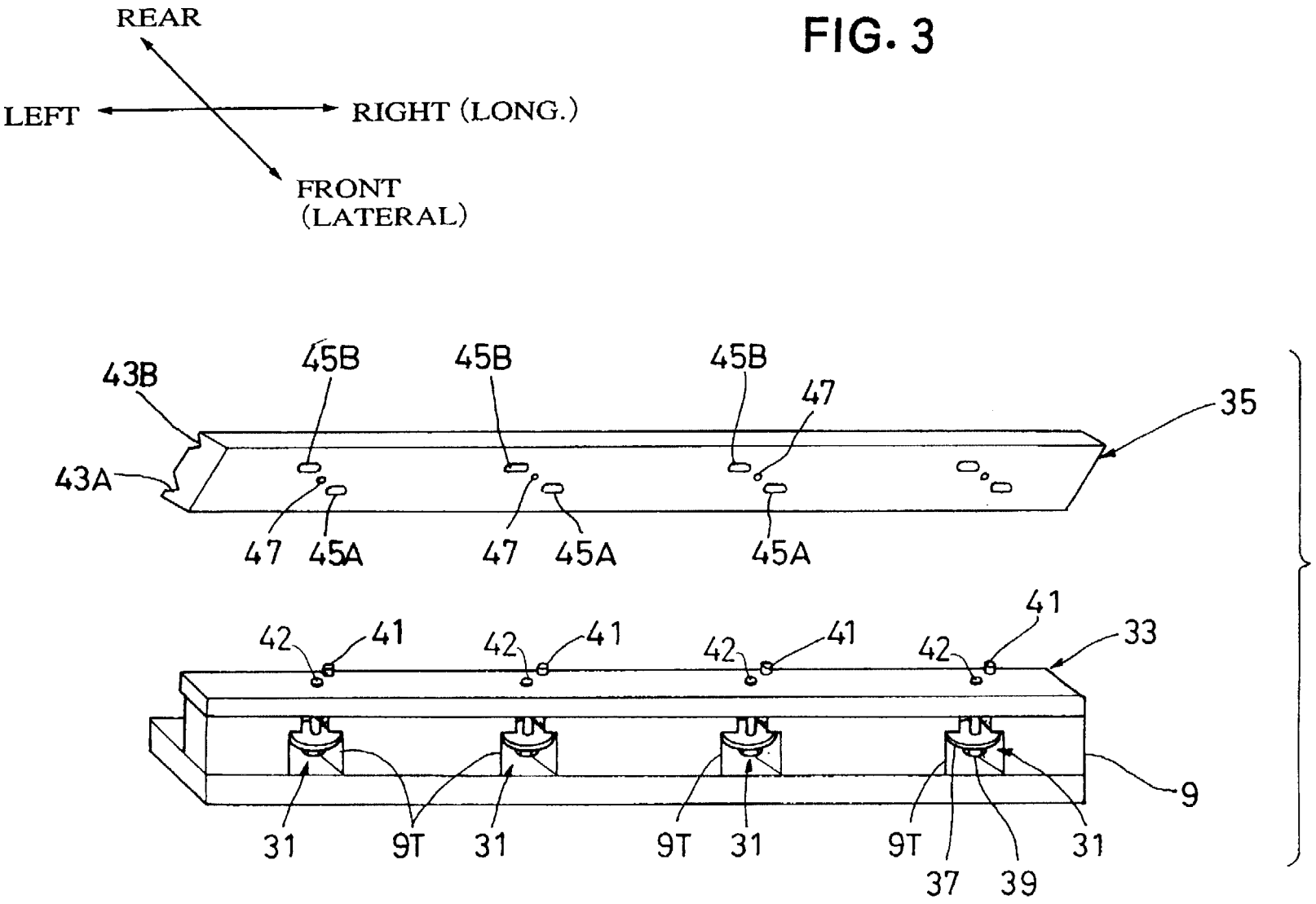
FIG. 3 is a perspective view showing a die holder, a die base and the die of the die assembly shown in FIG. 2.

FIGS. 2 and 3 show an embodiment of the die assembly according to the present invention. In these drawings, the die assembly is roughly composed of a die holder 9, a die base 33, and a die 35. Further, the die base 33 is fixed to the die holder 9 with a plurality of fixing members 31, each composed of a bolt 39 and a washer 37.

The die holder 9 is fixed to a lower table 3 by appropriated fixing members (not shown). The base 33 is fixed to the die holder 9 by use of the fixing members 31, so that the fixed position of the die base 33 relative to the die holder 9 can be adjusted. The die 35 is removably mounted onto the die base 33.

In more detail, the die holder 9 is formed with a plurality of T-shaped recessed portions 9T arranged in the longitudinal direction and on the lower surface thereof in such a way as to be opened toward one side surface thereof. Each of the fixing members 31 (a bolt 39 and a washer 37) is located at each T-shaped recessed portion 9T to fix the die base 33 to the die holder 9 at a plurality of positions.

The die base 33 is composed of an elongated plate extending in the longitudinal direction (perpendicular to the paper in FIG. 2 and in the horizontal direction in FIG. 3). The die base 33 has a plurality of engage members 41 (e.g., pins) arranged in a straight line along the longitudinal direction and on the upper surface thereof at such positions as to be offset from the central longitudinal line toward the rear side in the lateral direction thereof (toward the left side in FIG. 2). In addition, the die base 33 is formed with a plurality of threaded holes 42 arranged also in a straight line along the central longitudinal line thereof, into which the bolts 39 of the fixing members 31 are screwed for engagement.

On the other hand, the die 35 is also composed of an elongated plate extending in the longitudinal direction (perpendicular to the paper in FIG. 2 and in the horizontal direction in FIG. 3). The die 35 is formed with a first V-shaped groove 43A and a second V-shaped groove 43B (the widths of these grooves 43A and 43B are different from each other) arranged on the upper surface thereof in parallel to each other extending in the longitudinal direction thereof at such positions as to be offset from the central longitudinal line toward both the rear and front sides in the lateral direction thereof, respectively (toward the left (rear) and right (front) sides in FIG. 2).

The die 35 is further formed with a plurality of first engage slots 45A and a plurality of second engage slots 45B both arranged in a straight line along the longitudinal direction of the die 35 and on the lower surface thereof at such positions as to be offset from the central longitudinal line toward both the rear and front sides in the lateral direction thereof (toward the left (rear) and right (front) sides in FIG. 2). In addition, the base 35 is formed with a plurality of threaded holes 47 arranged also in a straight line along the central longitudinal direction thereof, into which the bolts 39 of the fixing members 31 are screwed, where necessary.

Here, it should be noted that the first and second slots 45A and 45B are offset toward both (left and right in FIG. 3) sides from each other along the longitudinal direction of the die 35, with the threaded holes 47 being centered between slots 45A and 45B, respectively. Further, a distance A between the central bottom line of the first V-shaped groove 43A and the center of the first engage slot 45A is determined to be equal to a distance B=A between the central bottom line of the second V-shaped groove 43B and the center of the second engage slot 45B, as shown in FIG. 2. Therefore, both the first and second slots 45A and 45B are engageable with the engage members 41 of the die base 33, when the die 35 is reversed in the lateral (width) direction (the rear and front sides are reversed).

To assemble die 35, die base 33 and die holder 9 into the die assembly (when the first V-shaped groove 43A is used as the die), the first engage slots 45A formed on the lower surface of the die 35 are engaged with the engage members 41 formed on the upper surface of the die base 33, and further the fixing members 31 temporarily attached to the die base 33 are located to the T-shaped recessed portions 9T formed at the lower portion of the die holder 9. After that, the first V-shaped groove 43A is aligned with an upper punch 7 fixed to an upper table 1 by adjustably moving the die base 33 in the lateral direction. After alignment of the die 35 (e.g., the first V-shaped groove 43A) and the punch 7, the die base 33 is fixed to the die holder 9 by fastening the bolts 39 of the fixing members 31.

Under these conditions that the die base 33 is fixed to the die holder 9, when the first V-shaped groove 43A is required to be replaced with the second V-shaped groove 43B, the die 35 is removed from the die base 33, and then the removed die 35 is reversed in the lateral (rear and front) direction. Further, the die 35 is mounted again on the die base 33 by engaging the second engage slots 45B with the engage members 41. Under these conditions, the second V-shaped groove 43B is to be aligned with the punch 7 without need of any additional alignment work, so that it is possible to immediately start the punching operation with cooperation between the second V-shaped groove 43B and the punch 7.

In other words, in the die assembly according to the present invention, once the die base 33 has been fixed to the die holder 9 after alignment with the punch 7, it is possible to selectively use any one of the first and second V-shaped grooves 43A and 43B as the die immediately, without need of any additional alignment with the punch 7, by simply engaging any one of the first and second engage slots 45A and 45B of the die 35 with the engage members 41 of the die base 33.

Figure 5A:
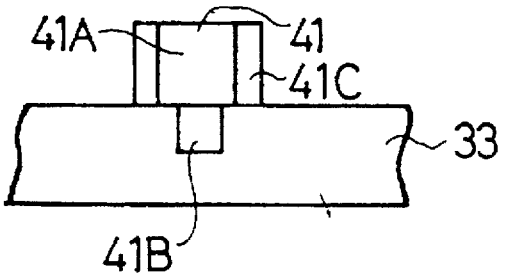
FIG. 5A is an enlarged view of an engage member having a roller on the outer circumference thereof.

The advantages of the die assembly according to the present invention will be described hereinbelow. In the die assembly shown in FIGS. 2 and 3, it should be noted that a plurality of the engage members 41 are used as a tool reference plane. Therefore, when the engage members 41 are pins, as depicted in FIG. 5A, it is possible to machine the pins 41 by lathe turning at high precision and relatively easily. In addition, when the engage pins 41 are used, it is preferable to use eccentric pins such that a small-diameter portion 41B of the pin implanted into the die base 33 is formed slightly eccentric with respect to a large-diameter portion 41A projected from the die base 33. In this case, the tool reference plane (composed of a plurality of the outer circumferential surfaces of the pins 41) can be adjusted finely by rotating the pins slightly, and thereby the locating work of the tool reference plane can be simplified and achieved precisely.

Further, since the engage members 41 are arranged so as to be offset rearward from the central position in the lateral (width) direction of the die base 33, when any of the first and second engage slots 45A and 45B of the die 35 are selectively engaged with the engage members 41, it is possible to prevent the die 35 from being dislocated in the lateral direction of the die base 33 (frontward or rearward). Further, the slots 45A and 45B can be formed additionally in the old dies already prepared through a simple additional processing or machining.

Further, since the engage members 41 are positioned so as to be offset frontward and away from the central position in the lateral (width) direction of the die base 33, when the die 35 is mounted onto the die base 33, it is possible to engage the engage slots 45A or 45B with the engage members 41 by bringing up the front side of the die 35, so that the die 35 can be mounted on the die base 33 safely and firmly by seeing the engage conditions between the engage slots 45A or 45B and the engage members 41, respectively. Further, it is also possible to arrange the engage members 41 at positions so as to be offset frontward from the central position in the lateral direction of the die base 33.

Further, since the first and second engage slots 45A and 45B (engaged with the engage members 41) are formed in the lower surface of the die 35 as the tool reference planes, instead of a long groove extending along the overall length of the die 35, high precision machining is required only for the engage slots 45A and 45B, without machining the overall length of the die 35 with high precision. Further, since the upper surface of the die base 33 and the lower surface of the die 35 are both usually polished into a mirror surface, respectively, it is possible to form the engage slots 45A and 45B and the engage holes (for the engage members 41) also with high precision and relatively easily.

Further, since the first and second engage slots 45A and 45B are formed at regular intervals along the longitudinal direction of the die 35 and further being offset from each other in the same longitudinal direction, the strength of the die 35 is not reduced markedly, so that it is possible to use a die 35 having the same thickness as conventional dies.

Further, when the widths of both the V-shaped grooves 43A and 43B are increased in the die 35 with a constant width, since the central bottom line positions of the V-shaped grooves 43A and 43B approach each other, the engage slots 45A and 45B tend to interfere with each other. In the die assembly according to the present invention, however, since the first and second engage slots 45A and 45B are formed so as to be offset from each other in the longitudinal direction, it is possible to prevent interference between the two engage slots 45A and 45B in the lateral direction of the die 35.

Further, in FIG. 2, the bolt 39 of the fixing member 31 reaches only the die base 33 without reaching the die 35. Even in this method, since the die 35 can be firmly mounted on the die base 33, there exists no problem. However, when the screw holes 47 are formed in the lower surface of the die 35 as shown in FIG. 3, and further when the bolts 39 of the fixing members 31 are elongated so as to reach the die 35, it is possible to fix the die 35 to the die base 33 in the same way as with the case of the conventional die assembly as shown in FIG. 1A. In this case, it is possible to use the conventional die as shown in FIG. 1A, as it is. In other words, when the first and second engage slots 45A and 45B are additionally formed in the lower surface of the conventional dies as shown in FIG. 1A (so as not to interfere with the already formed thread holes), it is possible to use the conventional dies, as they are, as the die assembly of the present invention.

Further, since the first and second engage slots 45A and 45B are formed at regular intervals along the longitudinal direction of the die 35 and are offset from each other in the same longitudinal direction, if the die 35 is distorted slightly in the lateral direction, it is unnecessary to correct the die 33 along the overall length of the die 33. That is, insofar as only the engage slots 45A and 45B at the distorted portion are corrected, it is possible to engage the engage slots with the engage members 41. In other words, the die 35 of the present invention can be mounted on the die base 33 even if distorted, as compared with the conventional die.

Further, since the die 35 can be slightly moved in the longitudinal direction thereof relative to the die base 33 due to the slot engagement of the engage slots 45A and 45B and the engage members (pins) 41, it is possible to bring one die 35 into tight contact with another die.

Further, since the first and second engage slots 45A and 45B are formed in the lower surface of the die 35 an equal distance A=B (in FIG. 2) from the central bottom lines of the first and second V-shaped grooves 43A and 43B, respectively, when the widths of the first and second V-shaped grooves 43A and 43B are changed without changing the wall thickness T at the shoulder portions of the respective V-shaped grooves, it is possible to form the engage slots 45A and 45B at any positions under the conditions of A= B. In other words, it is possible to form various V-shaped grooves of different widths by use of the die 35 of a constant width.

Figure 4:
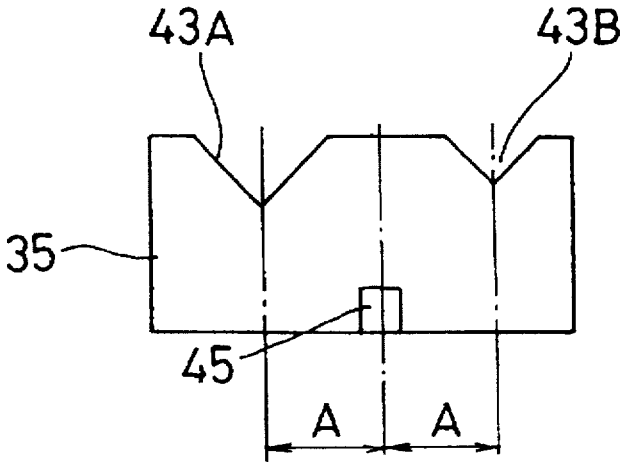
FIG. 4 is a side view showing a modification of the embodiment of the die according to the present invention.

Without being limited to only the embodiment shown in FIGS. 2 and 3, the die assembly of the present invention can be modified as follows: For instance, as shown in FIG. 4, it is possible to arrange a plurality of engage slots 45 on the lower surface of the die 35 in a straight line along the longitudinal direction thereof at a position located an equal distance A from both the central bottom line positions of the first and second V-shaped grooves 43A and 43B formed on the upper surface of the die 35. These engage slots 45 are engaged with the engage members 41 in common for both the first and second V-shaped grooves 43A and 43B, respectively. In this modification, the number of the engage slots 45 can be reduced, so that the machining and processing can be further simplified.

Figure 5B:
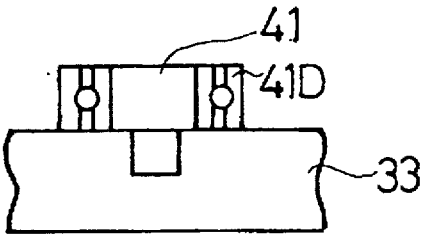
FIG. 5B is an enlarged view of an engage member having a radial bearing on the outer circumference thereof.

Further, it is also possible to attach a roller 41C (as shown in FIG. 5A) or a bearing 41D (as shown in FIG. 5B) to an outer circumferential surface of the pin 41 (the engage member) projecting from the upper surface of the die base 33, in such a way that the roller or the bearing can be well fitted into engagement with the engage slot 45A or 45B, respectively. In this modification, the die 35 can be moved more smoothly in the longitudinal direction of the die 35 relative to the die holder 33.

In addition, although the plurality of V-shaped grooves are provided on the upper surface of the die 35 in the above description, the present invention also can be applied to the case that single V-shaped groove is provided on the upper surface of the die 35 and the measure between the center of the V-shaped groove and the engage slot 45 is equal to the predetermined distance A. In this case, when varied dies 35 are mounted on the die base 33, the center of each die 35 is inevitably aligned with a punch.

As described above, in the die assembly according to the present invention, since the first and second engage slots are formed at positions an equal distance away from the first and second V-shaped grooves, after the die (one of the V-shaped groove) has been aligned with the punch and then the die base is fixed to the die holder, it is possible to replace the V-shaped grooves with each other without any alignment with the punch, so that the die replacement work can be simplified markedly. In other words, any of the first and second engage slots can be used in common for alignment of both the first and second V-shaped grooves with the punch.

Further, since the first and second engage slots are used instead of the engage groove, it is possible to form the slots at high precision and relatively easily, as compared with the engage groove.

Further, the engage slots can be formed by additionally machining the die already prepared. Moreover, various V-shaped grooves of different widths can be formed in a die with a constant width.

What is claimed is:

1. A die for a press brake, comprising:

a die body having an upper surface and a lower surface separated by a distance defining a depth of said die body;

a first groove formed in the upper surface of said die body so as to extend in a longitudinal direction thereof, said first groove having a V-shaped cross section, a bottom and a centerline which extends in a longitudinal direction of said die at the bottom of said first groove;

a second groove formed in the upper surface of said die body so as to extend in parallel to the first groove, said second groove having a V-shaped cross section, a bottom and a centerline which extends in the longitudinal direction of said die at the bottom of said second groove;

a plurality of first slots formed in the lower surface of said die body and extending to only a predetermined portion of said depth of said die body, said plurality of first slots extending in parallel to the first groove, said plurality of first slots being displaced from a first vertical plane including the centerline of the first groove by a predetermined distance; and a plurality of second slots formed in the lower surface of said die body and extending to only a predetermined portion of said depth of said die body, said plurality of second slots extending in parallel to the second groove, said plurality of second slots being displaced from a second vertical plane including the centerline of the second groove by a distance equal to said predetermined distance;

wherein said first slots are offset from said second slots, respectively, in the longitudinal direction of said die.

2. A die assembly for a press brake, comprising a die having a die body with an upper surface and a lower surface separated by a distance defining a depth of said die body, and including:

a first groove formed in the upper surface of said die body so as to extend in a longitudinal direction thereof, said first groove having a V-shaped cross section, a bottom and a centerline which extends in a longitudinal direction of said die at the bottom of said first groove;

a second groove formed in the upper surface of said die body so as to extend in parallel to the first groove, said second groove having a V-shaped cross section, a bottom and a centerline which extends in the longitudinal direction of said die at the bottom of said second groove;

a plurality of first slots formed in the lower surface of said die body and extending to only a predetermined portion of said depth of said die body, said plurality of first slots extending in parallel to the first groove, said plurality of first slots being displaced from a first vertical plane including the centerline of the first groove by a predetermined distance; and a plurality of second slots formed in the lower surface of said die body and extending to only a predetermined portion of said depth of said die body, said plurality of second slots extending in parallel to the second groove, said plurality of second slots being displaced from a second vertical plane including the centerline of the second groove by a distance equal to said predetermined distance;

a die base supporting said die thereon and having a plurality of engaging members arranged on the upper surface thereof, said engaging members being engageable with said first slots when said die is arranged at a first position and with said second slots when said die is arranged at a second position horizontally turned by 180 degrees from the first position;

a die holder fixed to a lower table of a press brake and supporting said die base thereon; and fixing members for fixing said die base to said die holder;

wherein said first slots are offset from said second slots, respectively, in the longitudinal direction of said die.

3. The die assembly for a press brake of claim 2, wherein said engaging members are pins projecting upwards from aid upper surface of said die base.

4. The die assembly for a press brake of claim 3, wherein said pins are so arranged as to be offset from the longitudinal centerline of said die base in a lateral direction of the die base.

5. The die assembly for a press brake of claim 2, wherein each of said engaging members comprises a pin and a roller surrounding the outer circumference thereof.

6. The die assembly for a press brake of claim 2, wherein each of said engaging members comprises a pin and a bearing surrounding the outer circumference thereof.

7. The die assembly for a press brake of claim 3, wherein each of said engage pins comprises a large-diameter portion and a small-diameter portion implanted in said die base, said large-diameter portion being so formed as to be eccentric from the small diameter portion to facilitate fine positional adjustment of said pin.

* * * * *

UNITED STATES PATENT AND TRADEMARK OFFICE

CERTIFICATE OF CORRECTION

PATENT NO. : 5,711,181

DATED : Jan. 27, 1998

INVENTOR(S) : Nobuya Mitsuyoshi

It is certified that error appears in the above-identified patent and that said Letters Patent is hereby corrected as shown below:

ON THE TITLE PAGE:

Item [75] Inventor: Nobuya Mitsuyoshi, Hiroshima, Japan

Signed and Sealed this

Twenty-third Day of February, 1999

*Attest:*

Q. TODD DICKINSON

*Attesting Officer*

*Acting Commissioner of Patents and Trademarks*